United States Patent [19]

Salam

[11] 4,163,332

[45] Aug. 7, 1979

[54] MATRIX DISPLAY DEVICE

[76] Inventor: Hassan P. A. Salam, 80 Vicarage Ct., London, W.8, England

[21] Appl. No.: 873,600

[22] Filed: Jan. 30, 1978

Related U.S. Application Data

[63] Continuation-in-part of Ser. No. 729,729, Oct. 5, 1976, abandoned.

[51] Int. Cl.[2] ..... G09F 9/30; G09F 13/04

[52] U.S. Cl. ..... 40/449; 40/463; 340/378 A; 340/764; 340/783

[58] Field of Search ..... 40/447, 449, 450, 452, 40/426, 463, 468, 469, 581, 582; 340/376, 378 R, 378 A, 336, 324 R, 324 M, 373

[56] References Cited

U.S. PATENT DOCUMENTS

| | | | |
|---|---|---|---|
| 755,272 | 3/1904 | Burnham | 40/450 |
| 3,210,757 | 10/1965 | Jacob | 340/373 |
| 3,295,238 | 1/1967 | Winrow | 40/449 |
| 3,518,664 | 6/1970 | Taylor | 340/378 R |
| 3,562,938 | 2/1971 | Salam | 40/446 |
| 3,745,563 | 7/1973 | Jones et al. | 40/447 |
| 4,040,193 | 8/1977 | Masuda et al. | 40/449 |
| 4,070,668 | 1/1978 | Kawaharada et al. | 340/373 |

FOREIGN PATENT DOCUMENTS

| | | | |
|---|---|---|---|
| 24108 | of 1913 | United Kingdom | 40/446 |

*Primary Examiner*—John F. Pitrelli
*Assistant Examiner*—G. Lee Skillington
*Attorney, Agent, or Firm*—Lawrence E. Laubscher

[57] ABSTRACT

A matrix display comprises an array of display elements arranged in vertical and horizontal rows. Each element comprises a vane pivotally mounted for movement between stable positions in one of which the vane covers a light-transmissive area contained in an opaque member arranged to be illuminated from behind by a first light source and displays a low-reflectance face to an observer. In a second stable position the vane exposes the illuminated area to the observer and also reflects light from a second source towards the observer, for which purpose the vane may be supported at an acute angle to the opaque member. Each vane is fastened to a permanent magnet arranged to cooperate with a reversibly polarizable electromagnet to be moved from one stable position to the other. In one embodiment an array of electromagnets, one for each horizontal or vertical row of shutters, is traversed across the array and the electromagnets are individually selectively energized to produce a required display. A small permanent magnet may be affixed to the reflective surface of each vane, or a diametrally polarized magnet may be attached to the pivot axis.

15 Claims, 14 Drawing Figures

MATRIX DISPLAY DEVICE

CROSS REFERENCE TO RELATED APPLICATION

This application is a continuation-in-part of application Ser. No. 729,729 now abandoned entitled IMPROVED INFORMATION DISPLAY DEVICE, which was filed on Oct. 5, 1976 by the present applicant, Hassan Paddy Abdel Salam.

BACKGROUND OF THE INVENTION

1. Field of the Invention:

This invention relates to matrix display devices, that is to display devices comprising a large plurality of elements arranged adjacently and each individually controllable to display different aspects to an observer.

2. Description of the Prior Art

There are known in the art from United Kingdom patent specifications Nos. 355,440 and 934,001 electrically controlled dot matrix display devices in which each dot element includes a laminar member, having differently reflective opposed faces, arranged to be rotatable about an axis parallel to the plane of the array so as to build up characters out of selections of reflective dots.

For night viewing, it is necessary to illuminate the prior art displays from the front, using relatively remote light sources.

SUMMARY OF THE INVENTION

It is an object of the invention to provide a matrix display device which reduces or obviates disadvantages of the known art.

It is a specific object of the invention to provide a matrix display device providing an improved appearance both in daylight and in night-time operation.

It is also an object of the invention to enable the number of actuators required to set the display to a desired condition to be reduced.

An embodiment of the present invention comprises a two-dimensional array of display elements arranged in horizontal and vertical rows, each said element being settable to a first state in which it simultaneously displays to an observer two adjacent areas of which one is a light emissive area arranged to emit light towards said observer and the other is a reflective area arranged to reflect light towards the observer, and a second state in which said areas are replaced by a corresponding area of low reflectance, wherein said display may be viewed either by transmitted or by reflected light and wherein:

the light-emissive area of each said display element is a light-transmissive area in an otherwise opaque member;

each said display element includes a vane having a highly reflective face constituting said reflective area and another face of low reflectance;

said vane is arranged for pivotal movement about a hinge axis adjacent to said light transmissive area between a first position in which said vane covers said light transmissive area and exposes its low-reflectance area to the observer and a second position in which said vane uncovers said light transmissive area and exposes its highly reflective face to the observer;

said vane including a permanent magnet;

a reversibly energizable electromagnet is arranged to cooperate with said shutter permanent magnet to produce movement of said vane between each and the other of said first and second positions.

The present invention has the advantage of allowing back lighting of the device, yielding a high-contrast display at night having an appearance that compares favorably with light bulb matrix displays and may be of any chosen color and enabling the light sources to be placed within the device cabinet and thus better protected from the weather. Not only does the invention enhance the appearance of the display but it also enables the number of display element actuators to be reduced in a simple manner. These two advantages allow a low-cost internally illuminated display to be provided, which has the characteristic of being clearly readable in daytime when the internal lighting of the device is switched off.

The daytime appearance can, if desired, be enhanced by keeping the back lighting on. Such enhancement is particularly striking on overcast or foggy days.

BRIEF DESCRIPTION OF THE DRAWINGS

FIGS. 1–5 illustrate a display device 10 comprising an opaque sheet member 11 pierced by a matrix of equispaced rectangular apertures 12, each having an associated shutter 13. Each shutter 13 is pivotally mounted for movement about a horizontal pivot axis 14 so as either to occult or to expose the respective aperture 12. The side of each shutter 13 that is exposed to view when the associated aperture is occulted is made non-reflective, conveniently matte black, as is the major portion of the front surface 15 of sheet member 11. The other side of each shutter member 13, that is exposed to view when the shutter is pivoted downwards to expose the respective aperture 12, is made reflective. It may conveniently be painted white, or otherwise coated with a reflective material 13*a*, as is a magnet 24 which is affixed to this surface of the shutter and cooperates with an electromagnet to actuate the shutter between its open and closed positions as described in relation to FIGS. 2 and 3. When shutter 13 is opened it is supported at an acute angle to sheet 11 by a projection 18 extending forwardly from sheet 11, and conveniently formed integrally therewith. Brackets 16 extend from sheet 11 at each end of every shutter member to provide the required pivotal support for the shutters.

The shutters advantageously have a lateral width W slightly in excess of the width w of the apertures and a height H which slightly exceeds the height h of the apertures. Thus a strip 17 of the front surface 15 of sheet 11 bordering each aperture above and at each side is covered when the respective shutter is raised and exposed when the shutter is lowered. This marginal strip can be made reflective to match the shutter surface that is simultaneously exposed to view.

Figure 1:
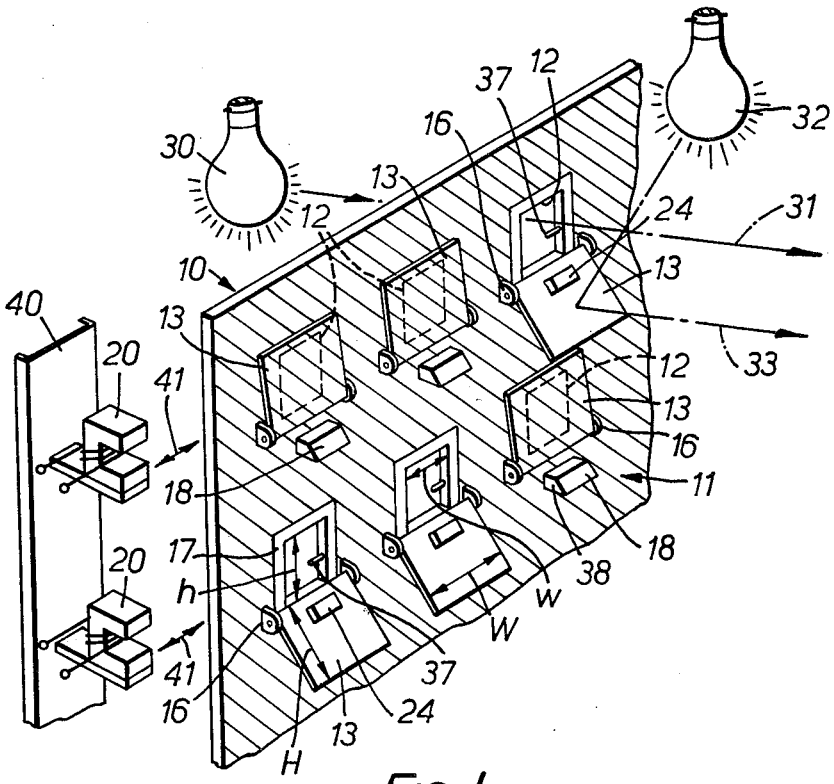
FIG. 1 is a perspective view of a portion of a display device in accordance with the invention.
Figure 2:
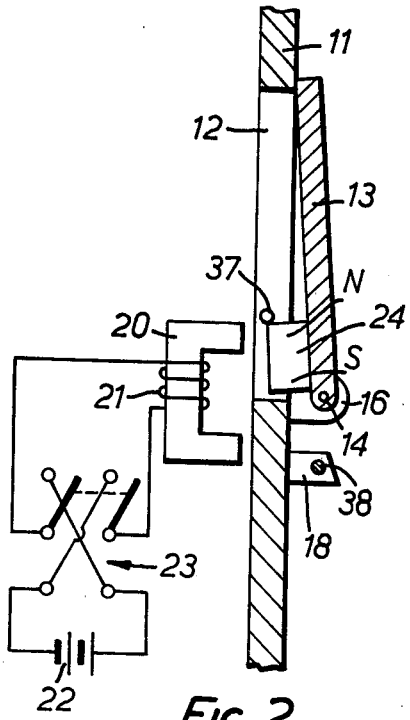
FIGS. 2 and 3 show sectional elevations through one element of a display device in accordance with the invention in its alternate operating conditions.

Movement of each shutter member between its raised (closed) and lowered (open) positions is effected by electromagnetic means, conveniently using a vertical array of electromagnets 20, one electromagnet for each row of apertures in the matrix. As shown in FIG. 1, the electromagnets 20 may be carried on a vertical support member 40 arranged by known means (not shown) for reciprocating movement in a horizontal direction (as indicated by arrows 41), with each of magnets 20 traversing a respective horizontal row of shutters 13 to cooperate with each in turn, as required. The electromagnets 20 are arranged to be energized selectively in either polarity, in such a manner that the direction of energization may be selected in respect of each shutter member as the magnet is caused to traverse the array. As shown in FIG. 2, the winding 21 of each electromagnet is connectable to a source 22 of direct current by way of a switch 23 operable to cause current to pass through the winding in either direction. In practice, switch 23 will most conveniently be a semiconductor switching arrangement arranged to be actuated synchronously with the movement of the magnet array past the shutters.

Figure 3:
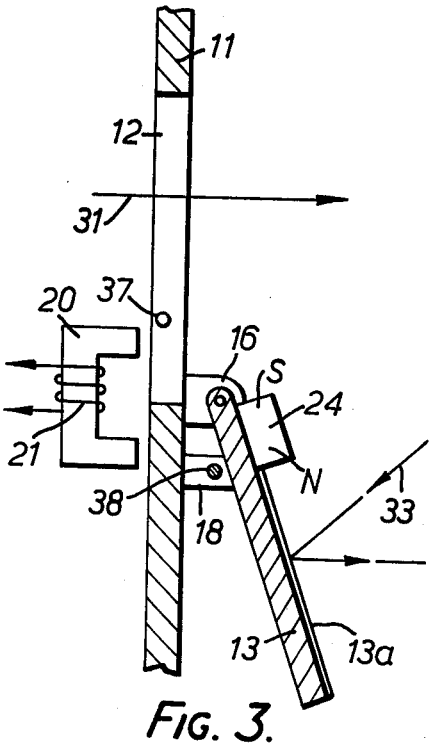
Figure 4:
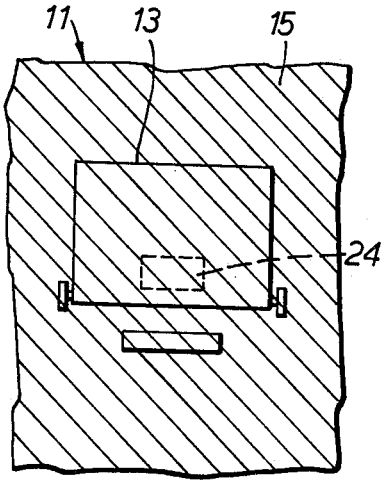
FIGS. 4 and 5 show to a reduced scale front elevations of the element of FIGS. 2 and 3 in its alternate conditions of operation.
Figure 5:
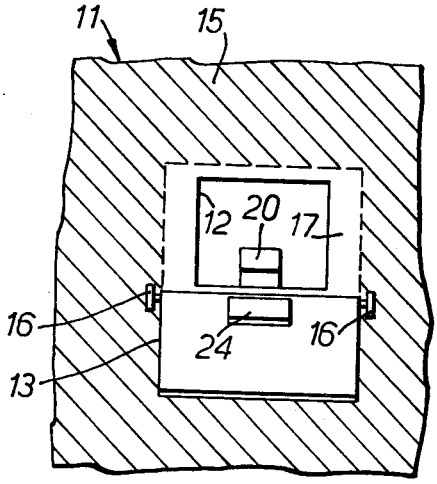

On each shutter 13 is fastened a permanent magnet 24 having opposed poles respectively adjacent the hinge axis and remote therefrom. The magnet polarity is the same for all the shutters and for the sake of convenience it will be assumed that, as denoted by references N and S, the north pole is remote from and the south pole adjacent to the hinge axis. If electromagnet 20, when positioned in the same vertical plane as the shutter magnet as shown in FIG. 5, is now energized to produce a north pole at its top and a south pole at its bottom and the shutter member is closed, as shown in FIG. 2, then the shutter magnet 24 will be repelled and rotated and the shutter 13 will be caused to pivot to its open position, as shown in FIG. 3. If, with the shutter in this open position, magnet 20 is energized so as to produce a south pole at its top and a north pole at its bottom, then magnet 24 will again be repelled and rotated, and shutter 13 will be caused to pivot to its closed position.

When shutter 13 is open as shown in FIG. 3 light from a source 30 of light (FIG. 1) positioned behind the sheet 11 may pass through the aperture 12 unobstructed by the shutter, as indicated by arrow 31, while light incident on the reflective exposed face 13*a* of the shutter from a source 32 will also be visible to an observer as indicated by arrows 33. When in its open position it will be seen that the shutter is held inclined to the vertical at an acute angle by the presence of support 18, since this increases the amount of light reflected towards the viewer from the source 32 above the shutter, which source may for example, be daylight or light from roof lighting. A sheet of light diffusing translucent material is advantageously placed behind or within the aperture 12, since this improves the daytime appearance by reflecting some of the ambient light incident on the front of the device, when the shutter is open. It also provides diffusion of the back light passing through the aperture during nighttime operation, thus assisting viewing of the display from positions other than directly in front of it.

The display elements described above are gravitationally bistable, but alternatively or additionally the elements may be made magnetically bistable by providing soft-iron pins 37, 38 each of which attracts the magnet 24 in a respective one of its stable positions, pin 37, which extends partly across the aperture 12 from a vertical edge thereof, when the shutter is closed and pin 38, which is conveniently located within projection 18, when the shutter is open.

The shutter member 13 should ideally be very thin, so as to reduce its mass as far as possible and thus increase the spaced of operation. The shutter and permanent magnet may be made as an integral unit, for example by forming the shutter by an injection molding process from a material that is permanently magnetable.

Figure 6A:
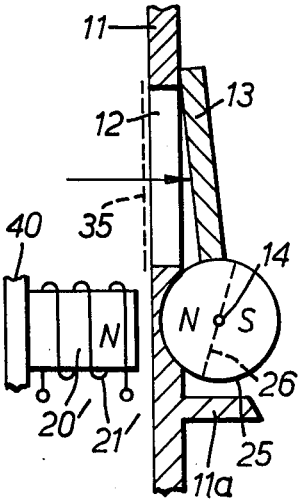
FIG. 6A is a sectional view of one element of a display device in accordance with another embodiment of the invention, in one operating condition.
Figure 6B:
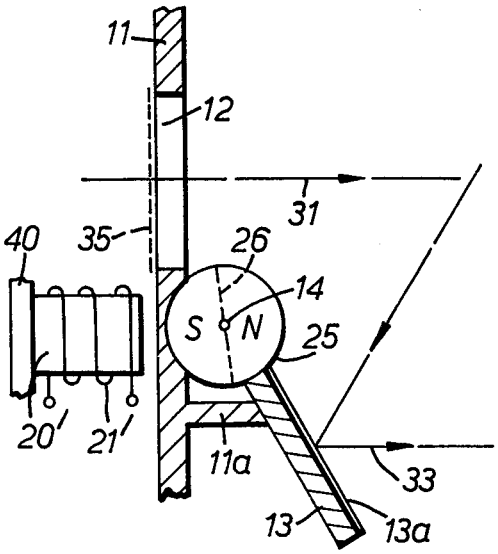
FIG. 6B is a sectional view of the element of FIG. 6A, in its other operating condition.

FIGS. 6A and 6B illustrate an alternative construction of shutter element, in which permanent magnet 24 of FIGS. 2–5 is replaced by a cylindrical magnet 25 mounted concentrically with shutter pivot axis 14 and magnetized transversely to the axis, so that the portion on one side of a diameter 26 represents a north magnetic pole and the portion on the other side of this diameter represents a south pole. The electromagnet 20' in this case is in the form of a rod or bar having its axis at right angles to the plane of the array. When it is desired to open the shutter from the closed position shown in FIG. 6A the winding 21' of electromagnet 20' is energized so as to produce adjacent magnet 25 a like pole to that presented by magnet 25, in the illustrated case, a north pole. It will be noted that the diameter 26 dividing the north and south polar regions of magnet 25 is inclined to the vertical, so that the field of this magnet is asymmetrically presented to electromagnet 20' in such a manner that the interaction of the fields of magnet 25 and electromagnet 20' produces on the magnet a torque tending to rotate the shutter clockwise as shown in the drawing. In the closed position of the shutter light 31 from a source disposed behind the shutter array will be obstructed by the closed shutter. With the shutter open, as shown in FIG. 6B, light from a source behind the shutter array will pass through aperture 12 as indicated at 31, while light from an overhead source will be reflected by the reflective inner face of the shutter as indicated at 33. From the open position of FIG. 6B the shutter is returned to its closed position by energizing/electromagnet 20' so that its end nearest magnet 25 becomes a south pole. It will be seen that because the position of shutter 13 in its open position is limited by projection 11*a*, the magnet 25 is again in such a position with respect to electromagnet 20' that a torque in the required direction, in this case anticlockwise, is produced.

Figure 7:
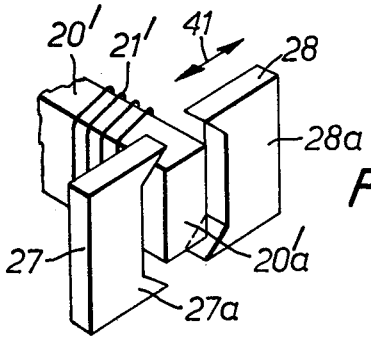
FIG. 7 is a schematic perspective illustration of a preferred embodiment of electromagnet for use in the invention.

Above a certain speed of travel of the electromagnets 20' there may be a tendency for the actuated shutters to bounce back, particularly when the shutters are being closed. To prevent this bounce it is possible to use a moving electromagnet assembly in which the pole of each electromagnet is flanked by soft-iron members, as shown in FIG. 7. Here an electromagnet 20' with its winding 21' presents an end face 20'*a* towards a shutter array (not shown). Two soft-iron members 27, 28 are arranged with their faces 27*a*, 28*a* coplanar with face 20'*a* and symmetrically with respect to electromagnet 20'. This arrangement ensures that when a shutter member is returned to its closed position, as shown in FIG. 6A, the shutter magnet 25 will interact with member 27 or 28, according to the direction of movement (indicated by arrow 41), to retain the shutter in its closed position and restrain shutter bounce.

It will be understood that the array of electromagnets 20 or 20' carried on a common support member 40 is arranged to move with respect to the shutter array so that in its limiting positions it is not aligned with the endmost vertical row of shutters, but leaves them free for the passage of light therethrough. In a modification which is not thought to require illustration, a horizontally aligned set of electromagnets is arranged to move vertically over the array. This alternative arrangement produces a more rapid change of display in some instances.

Figure 8:
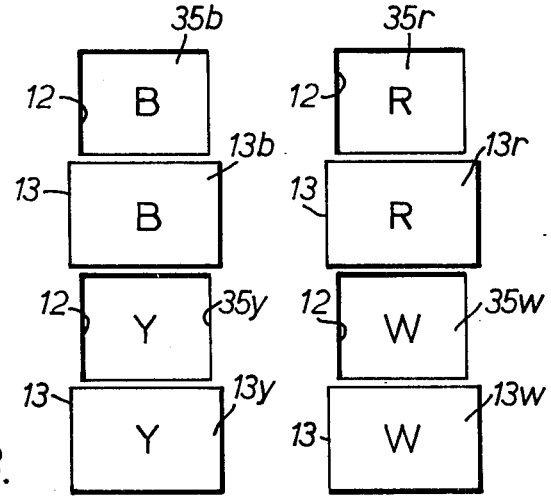
FIG. 8 is a front elevation of a portion of a modified display device.

A modification of the display device described above may be used to provide displays in different colors, as will now be described with reference to FIG. 8. In this Figure each of a group of four adjacent display elements is arranged to display a different color, when actuated. In the Figure, all the elements are shown as actuated together, which is not the only mode of operation of a selected group. In other modes three, two or one of the elements of each selected group will be actuated. The display will comprise a large plurality of groups, and when viewed from a sufficiently large distance each group will appear as a single dot having a color dependent on the combination of elements selected within it.

The group of elements illustrated comprises four apertures 12, which are individually provided with differently colored diffuser elements **35*b*, 35*r*, 35*y* and 35*w*, which may be assumed to pass preferentially light of the colors blue, red, yellow and white, respectively. The apertures are closed by respective shutters 13, which have their reflective surfaces coated with materials 13*b*, 13*r*, 13*y*, 13*w*** selectively reflective to the corresponding colors.

In daytime use, color is provided by the ambient lighting reflected by the colored shutter surfaces of the selected display elements, while for night-time operation the colored reflection of ambient lighting may be supplemented by colored light passing through the colored diffusers of the open apertures.

Obviously, sets of colors other than four may be controlled in the general manner disclosed above.

Figure 9:
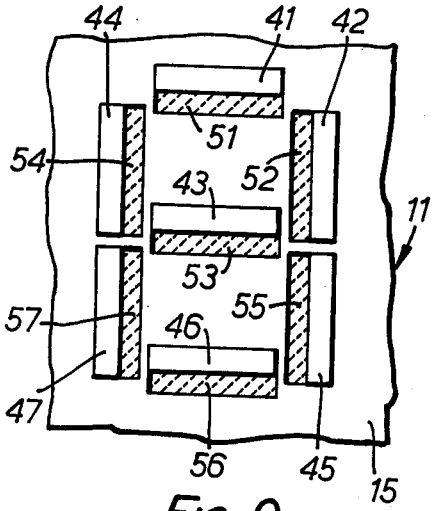
FIGS. 9 and 10 illustrate a 7-segment display device embodying the invention.
Figure 10:
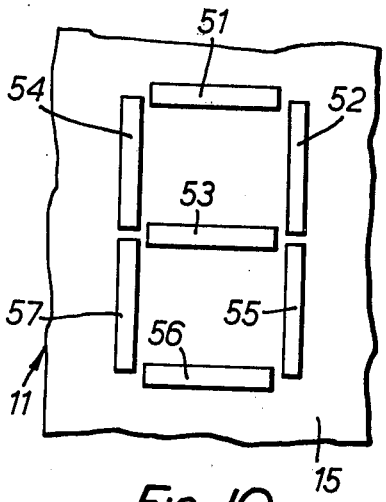

FIGS. 9 and 10 illustrate respectively the appearance in high and low ambient light conditions of a 7-segment display device embodying the invention. In each Figure, all of the display segments are shown as actuated to the "mark" position, so that a numeral "8" is displayed. In FIG. 9 there are shown the seven reflective shutter surfaces 41–47, each flanking a dispersive translucent surface 51–57, and all visible against a dark surface 15 of the opaque sheet 11.

Figure 11:
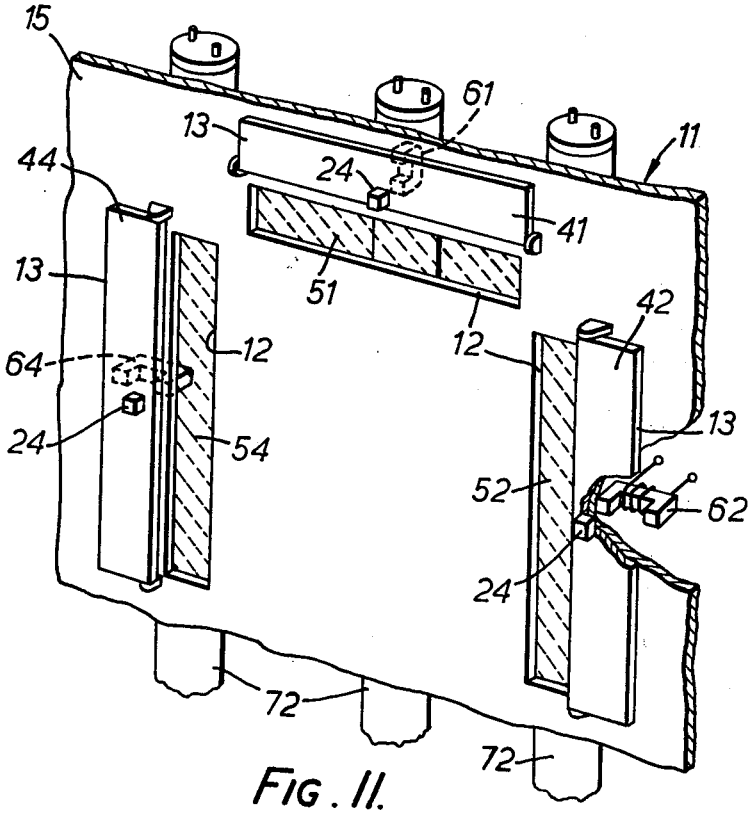
FIG. 11 shows to an enlarged scale a portion of the device of FIGS. 9 and 10.

FIG. 11 shows in some detail the construction of a part of the display device of FIGS. 9 and 10. An opaque sheet 11 is pierced by apertures 12 having the required forms and locations for the elements of the display. Each aperture 12 is controlled by a respective shutter 13 operated by a respective hidden reversibly energizable electromagnet 61, 62, 64, cooperating with a permanent magnet 24 of the associated shutter. The magnetic axis of magnet 24 is normal to the plane of the shutter. Surface 15 of sheet 11 is of low reflectance, conveniently black, while surfaces 41, 42, 44 of the shutters, exposed when they are positioned so as not to occult the respective apertures 12, are highly reflective. Apertures 12 are preferably filled by dispersive elements 51, 52, 54, to eliminate glare from lamps 72 which are disposed behind opaque sheet 11.

Figure 12:
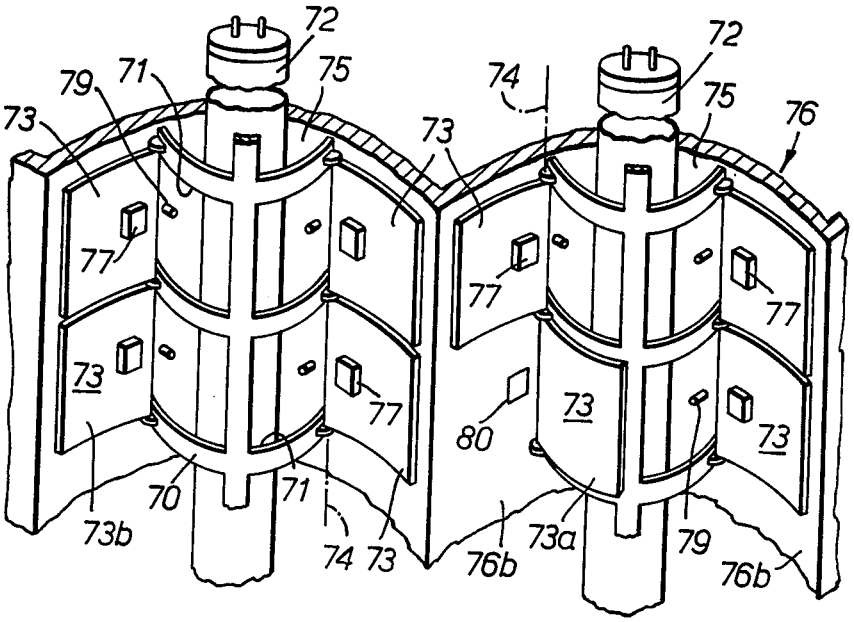
FIGS. 12 and 13 illustrate a modified embodiment of display device embodying the invention.
Figure 13:
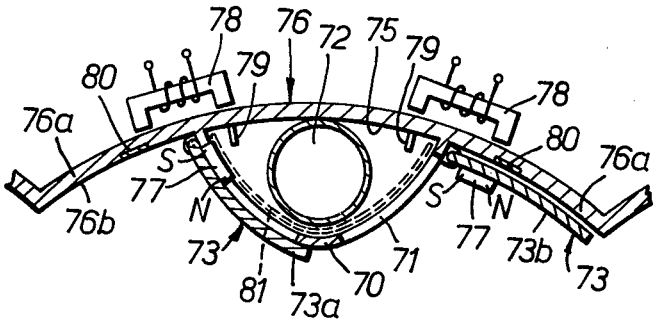

FIGS. 12 and 13 illustrate an embodiment in which particularly high efficiency of illumination is obtained. Opaque masking members 70 of arcuate section, each pierced by apertures 71, are interposed between an observer and respective vertically luminescent tubes 72 disposed within the recess of the mask. Each aperture 71 has an associated matingly curved shutter member 73 pivoted to mask member 70 for movement about a vertical hinge axis 74 adjacent an edge of the respective aperture 71 so as to be movable between a first or closed position, in which the respective aperture is covered and the shutter member displays a low-reflectance convex surface **73*a* to the observer, and a second or open position in which the shutter displays a concave and reflective surface 73*b* to the observer. Behind each lamp 72 is disposed a concave reflector 75 from which, when the shutter is open, some light from lamp 72 is reflected through aperture 71. Reflector 75 is formed by a reflective coating upon a member 76 of concavely arcuate section which extends laterally beyond masking member 70 to form extensions 76*a*. Other light from the lamp also passes directly through the aperture when the shutter is open, to pass directly to the observer or to be reflected towards the observer from concave shutter surface 73*b*. When in its open position, shutter 73 lies against respective extension 76*a* of the member 76. Those surfaces 76*b* of extensions 76*a* of member 76 which are visible to the observer when shutters 73** are closed are arranged to be of low reflectance.

Each shutter 73 comprises a permanent magnet 77 which cooperates with a reversible energizable electromagnet 78 (FIG. 13) to provide movement of the shutter between its open and closed positions. An electromagnet 78 may be provided for each shutter or a single electromagnet may be arranged to be traversed vertically along each column of shutters to actuate each in turn. Stability of shutters 73 in their open and closed positions may conveniently be provided by soft-iron members 79, 80 positioned for cooperation with the shutter permanent magnet 77. The electromagnet assembly is so arranged that when passing a group of display elements that are in said first state and that are required to remain in that same state the electromagnet assembly does not obstruct the passage of light that affects the appearance of said group of display elements.

A light-diffuser 81 (shown only in FIG. 13) may be positioned within mask member 70 to reduce glare, or this may be replaced by a member providing sets of color filters whereby the opening of adjacent shutters displays light of different colors to the observer. As in other embodiments, the light may be colored red, blue or green or remain as unfiltered "white" light. The reflective surface **73*b*** of the shutter of each aperture can be painted the same color as the filter of the aperture.

The arrangement in FIG. 12 is clearly readable in daylight with lamps 72 switched off, because of the reflectance of surface **73*b* of the shutter, and the reflectance of surface 75 and of the lamp 72**, which may be a fluorescent lamp. The appearance when viewed by daylight can be enhanced by turning on the lamps.

It is an advantage of the invention that inactive areas of the display, that is, those areas of which the appearance is unchanged by actuation of any display element, may be reduced to insignificant proportions, and it is an advantage of the embodiment in FIGS. 12 and 13 that when each of the display elements is in the brighter of its two states almost the whole area occupied by the array reflects ambient light and radiates light derived from said light source.

What is claimed is:

1. An electrically controlled information display device including a two-dimensional planar array of display elements arranged in horizontal and vertical rows, characterized in that:

each said display element is selectively settable to a first state in which there are simultaneously displayed to the observer two adjacent areas of which one is a light-emissive area arranged to emit light towards the observer and the other in a reflective area arranged to reflect light to the observer and to a second state in which each said area is replaced by a corresponding area of low reflectance;

the light-emissive area of each said display element is a light-transmissive area in an otherwise opaque member disposed between a light source and the observer;

each said display element includes a vane having a reflective face constituting said reflective area and an opposing face of lower reflectance constituting a said area of low reflectance;

each said vane is arranged for pivotal movement about a hinge axis adjacent to and to one edge of the respective said light-transmissive area between a first position in which said vane covers said light-transmissive area and exposes its lower-reflectance surface to the observer and a second position in which said vane uncovers said light-transmissive area and exposes its reflective face to the observer;

said vane comprises a permanent magnet arranged for cooperation with a respective one of an electromagnet assembly arranged for movement with respect to said array so that each said electromagnet is successively disposed for cooperation with each of a predetermined plurality of said permanent magnets to produce selective movement of the respective said vane between one and the other of said first and second positions;

stabilizing means are provided whereby each said vane is stable in each of said first and second positions;

said light source is common to a plurality of said display elements.

2. The invention claimed in claim 1 wherein said electromagnet assembly is so arranged that when passing a group of display elements that are in said first state and that are required to remain in that same state the electromagnet assembly does not obstruct the passage of light that affects the appearance of said group of display elements.

3. The invention claimed in claim 1 wherein when each of said display elements is in said first state substantially the whole area occupied by the array reflects ambient light and radiates light derived from said light source.

4. The invention claimed in claim 1 wherein said stabilizing means comprises two soft-iron members disposed respectively to cooperate with a respective said permanent magnet to retain the respective vane in said first and in said second positions respectively.

5. The invention claimed in claim 1 wherein each said vane is pivoted for movement about said hinge axis between said first and second positions such that the vane is gravitationally stable in each said position.

6. The invention claimed in claim 1 wherein each electromagnet is flanked by a soft-iron member cooperating with said permanent magnets to reduce bounce of said vanes when actuated.

7. The invention claimed in claim 1 and including a plurality of sets of light transmissive areas and vanes, each light transmissive area in a said set having associated therewith an optical filter selectively passing light of a color different from the light passed by the other filters in the set, and the vane associated with each said light transmissive area having a reflective surface selectively reflecting light of the color preferentially passed by the filter associated with the corresponding light transmissive area.

8. The invention claimed in claim 1 wherein each said light transmissive area comprises a light diffuser.

9. An electrically controlled matrix information display device including a two-dimensional array of display elements arranged in horizontal and vertical rows, characterized in that each said element is settable to a first state in which it simultaneously displays to an observer two adjacent areas of which one is a light emissive area arranged to emit light towards said observer and the other in a reflective area arranged to reflect light towards the observer, and a second state in which each said area is replaced by a corresponding area of low reflectance, whereby said display may be viewed both by transmitted light and by reflected light;

the light emissive area of each said display element is a light-transmissive area in an otherwise opaque member arranged between a light source common to a plurality of said display elements and the observer;

each said display element includes a vane having a reflective face constituting said reflective area and another face of lower reflectance constituting a said area of low reflectance;

said vane is arranged for pivotal movement about a hinge axis adjacent to and to one edge of said light transmissive area between a first position in which said vane covers said light transmissive area and exposes its lower-reflectance face to the observer and a second position in which said vane uncovers said light transmissive area and exposes it reflective face to the observer;

said vane comprises a permanent magnet; and magnet means are arranged to cooperate with said permanent magnet for selectively producing movement of said vane between one and the other of said first and second positions.

10. The invention claimed in claim 9 wherein said magnet means is disposed so that light can pass from said light source through said light-transmissive areas unobstructed by said magnet means.

11. The invention claimed in claim 9 wherein when each of said display elements is in said first state substantially the whole area occupied by the array reflects ambient light and radiates light derived from said light source.

12. The invention claimed in claim 9 and including a plurality of sets of light transmissive areas and vanes, each light transmissive area in a said set having associated therewith an optical filter selectively passing light of a color different from the light passed by the other filters in the set, and the vane associated with each said light transmissive area having a reflective surface selectively reflecting light of the color preferentially passed by the filter associated with the corresponding light transmissive area.

13. The invention claimed in claim 9 wherein each said light-transmissive area comprises a light diffuser.

14. A display device in accordance with claim 1 wherein each of said display elements includes a rectangular vane having a length substantially greater than its width and at least one set of said elements is arranged to form a seven-segment display pattern whereby representations of decimal digits may be displayed to the observer.

15. A display device in accordance with claim 9 wherein each of said display elements includes a rectangular vane having a length substantially greater than its width and at least one set of said elements is arranged to form a seven-segment display pattern whereby representations of decimal digits may be displayed to the air.

* * * * *

US004163332B1

REEXAMINATION CERTIFICATE (2516th)

United States Patent [19]

Salam

[11] B1 4,163,332

[45] Certificate Issued Apr. 4, 1995

[54] MATRIX DISPLAY DEVICE

[75] Inventor: Hassan P. A. Salam, London, England

[73] Assignee: Unisplay S. A., Geneva, Switzerland

Reexamination Request:
No. 90/003,565, Sep. 12, 1994

Reexamination Certificate for:

| | |
|---|---|
| Patent No.: | **4,163,332** |
| Issued: | **Aug. 7, 1979** |
| Appl. No.: | **873,600** |
| Filed: | **Jan. 30, 1978** |

Related U.S. Application Data

[63] Continuation-in-part of Ser. No. 729,729, Oct. 5, 1976, abandoned.

[51] Int. Cl.[6] ..... G09F 9/00

[52] U.S. Cl. ..... 40/449; 40/463; 340/815.44; 340/815.53; 345/111

[58] Field of Search ..... 40/447, 449, 450, 452, 40/426, 463, 468, 469, 581, 582; 340/815.44, 815.53; 345/111

[56] References Cited

U.S. PATENT DOCUMENTS

| | | |
|---|---|---|
| 1,191,023 | 7/1916 | Naylor . |
| 1,765,215 | 6/1930 | Duchard . |
| 3,562,938 | 2/1971 | Salem . |
| 3,916,403 | 10/1974 | Mandszu . |
| 4,070,668 | 6/1976 | Kawaharada . |
| 4,215,338 | 7/1980 | Selig . |

FOREIGN PATENT DOCUMENTS

| | | |
|---|---|---|
| 464187 | 3/1914 | France . |
| 355440 | 8/1931 | United Kingdom . |

OTHER PUBLICATIONS

Prior Invention of G. Selig with Corroborative Documents and Declaration, later disclosed in U.S. Pat. No. 4,215,338.

*Primary Examiner*—Brian K. Green

[57] ABSTRACT

A matrix display comprises an array of display elements arranged in vertical and horizontal rows. Each element comprises a vane pivotally mounted for movement between stable positions in one of which the vane covers a light-transmissive area contained in an opaque member arranged to be illuminated from behind by a first light source and displays a low-reflectance face to an observer. In a second stable position the vane exposes the illuminated area to the observer and also reflects light from a second source towards the observer, for which purpose the vane may be supported at an acute angle to the opaque member. Each vane is fastened to a permanent magnet arranged to cooperate with a reversibly polarizable electromagnet to be moved from one stable position to the other. In one embodiment an array of electromagnets, one for each horizontal or vertical row of shutters, is traversed across the array and the electromagnets are individually selectively energized to produce a required display. A small permanent magnet may be affixed to the reflective surface of each vane, or a diametrally polarized magnet may be attached to the pivot axis.

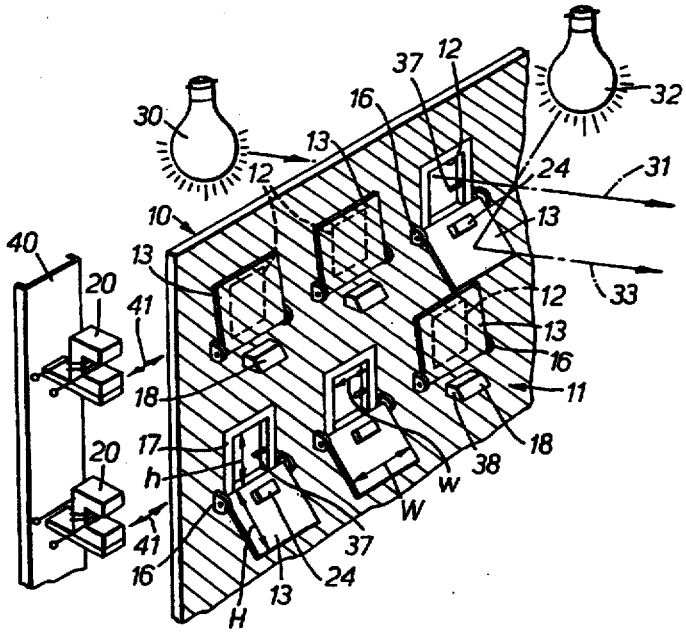

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1-15 is confirmed.

* * * * *

US004163332B1

REEXAMINATION CERTIFICATE (2661st)

United States Patent [19]

Salam

[11] B1 4,163,332

[45] Certificate Issued Sep. 5, 1995

[54] MATRIX DISPLAY DEVICE

[75] Inventor: Hassan P. A. Salam, London, England

[73] Assignee: Unisplay S.A., Geneva, Switzerland

Reexamination Request:
No. 90/003,715, Feb. 3, 1995

Reexamination Certificate for:

| | |
|---|---|
| Patent No.: | **4,163,332** |
| Issued: | **Aug. 7, 1979** |
| Appl. No.: | **873,600** |
| Filed: | **Jan. 30, 1978** |

Related U.S. Application Data

[63] Continuation-in-part of Ser. No. 729,729, Oct. 5, 1976, abandoned.

[51] Int. Cl.[6] ..... G09F 9/00

[52] U.S. Cl. ..... 40/449; 40/463; 340/815.44; 340/815.53; 345/111

[56] References Cited

U.S. PATENT DOCUMENTS

| | | |
|---|---|---|
| 1,191,023 | 7/1916 | Naylor . |
| 1,765,215 | 6/1930 | Duchard . |
| 3,186,116 | 6/1965 | Todt et al. . |
| 3,266,033 | 8/1966 | Frohbach . |
| 3,562,938 | 2/1971 | Salam . |
| 3,592,527 | 7/1971 | Conners et al. . |
| 3,916,403 | 10/1974 | Mandszu . |
| 4,070,668 | 6/1976 | Kawaharada . |
| 4,115,936 | 9/1978 | Nidelkoff . |
| 4,215,338 | 7/1980 | Seleg . |

FOREIGN PATENT DOCUMENTS

| | | |
|---|---|---|
| 464187 | 3/1914 | France . |
| 355440 | 8/1931 | United Kingdom . |

*Primary Examiner*—Brian K. Green

[57] ABSTRACT

A matrix display comprises an array of display elements arranged in vertical and horizontal rows. Each element comprises a vane pivotally mounted for movement between stable positions in one of which the vane covers a light-transmissive area contained in an opaque member arranged to be illuminated from behind by a first light source and displays a low-reflectance face to an observer. In a second stable position the vane exposes the illuminated area to the observer and also reflects light from a second source towards the observer, for which purpose the vane may be supported at an acute angle to the opaque member. Each vane is fastened to a permanent magnet arranged to cooperate with a reversibly polarizable electromagnet to be moved from one stable position to the other. In one embodiment an array of electromagnets, one for each horizontal or vertical row of shutters, is traversed across the array and the electromagnets are individually selectively energized to produce a required display. A small permanent magnet may be affixed to the reflective surface of each vane, or a diametrally polarized magnet may be attached to the pivot axis.

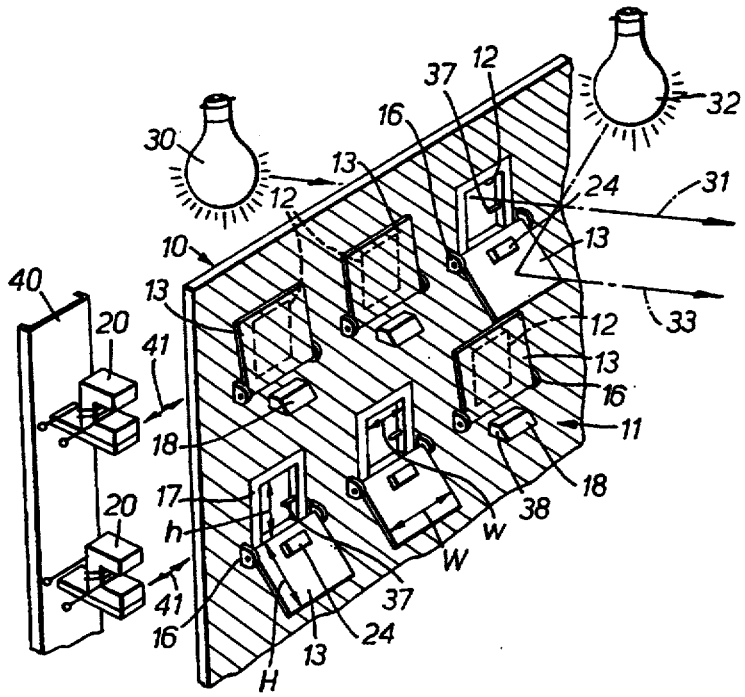

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *